US005716311A

United States Patent [19]

Novick et al.

[11] Patent Number: 5,716,311

[45] Date of Patent: Feb. 10, 1998

[54] APPARATUS AND METHOD FOR MEASURING AND REGULATING WEB TENSION IN A FORMER SECTION OF A FOLDING MACHINE FOR A PRINTING PRESS

[75] Inventors: Michael Alexander Novick, New Durham; David Charles Burke, Portsmouth, both of N.H.

[73] Assignee: Heidelberger Druckmaschinen AG, Heidelberg, Germany

[21] Appl. No.: 800,908

[22] Filed: Feb. 13, 1997

Related U.S. Application Data

[63] Continuation of Ser. No. 462,449, Jun. 5, 1995, abandoned, which is a continuation of Ser. No. 148,092, Nov. 4, 1993, abandoned.

[51] Int. Cl.[6] ..... B31B 1/26

[52] U.S. Cl. ..... 493/32; 493/29; 493/37

[58] Field of Search ..... 493/37, 23, 29, 493/32, 405, 45, 439, 414, 26, 443, 446, 38, 435; 364/506, 508; 242/418.1; 73/862.46, 862, 479; 101/181, 278; 226/95

[56] References Cited

U.S. PATENT DOCUMENTS

| | | | |
|---|---|---|---|
| 1,305,129 | 5/1919 | Lange . | |
| 2,107,462 | 2/1938 | Wood . | |
| 3,608,889 | 9/1971 | Woessner | 270/76 |
| 3,834,689 | 9/1974 | Lee et al. | 270/41 |
| 4,231,560 | 11/1980 | Stohlguist | 493/29 |
| 4,644,785 | 2/1987 | Doyle | 73/151 |
| 4,775,086 | 10/1988 | Kataoka | 226/44 |
| 4,848,630 | 7/1989 | Niestrath | 226/4 |
| 5,137,505 | 8/1992 | Ishii | 493/248 |
| 5,150,265 | 9/1992 | Tanaka | 360/71 |
| 5,176,334 | 1/1993 | Dreschau | 242/75.5 |
| 5,176,371 | 1/1993 | Rau | 270/42 |
| 5,365,843 | 11/1994 | House | 101/228 |
| 5,449,156 | 9/1995 | Gnuechtel | 270/5 |

*Primary Examiner*—Joseph J. Hail, III
*Assistant Examiner*—Christopher W. Day
*Attorney, Agent, or Firm*—Kenyon & Kenyon

[57] ABSTRACT

A web tension measurement and control device and method for a folding machine are provided. The tension of a web over a former board is transduced by a sensor mounted on a former board adjustment rod. The former board adjustment rod is coupled at a first end to a portion of the former board near the edge at which the web departs the former board, and at a second end to a frame. The sensor transduces a signal proportional to the strain to which it is subjected. The signal is provided to a gauge for visualization of a value of the web tension, and/or to an information processing device which generates one or more control signals functions of the measured value of the web tension. The one or more control signals may be fed back to a driven roller upstream of the former board and/or to a set of nip rollers downstream of the former board in order to actuate them so as to produce a desired web tension.

12 Claims, 2 Drawing Sheets

APPARATUS AND METHOD FOR MEASURING AND REGULATING WEB TENSION IN A FORMER SECTION OF A FOLDING MACHINE FOR A PRINTING PRESS

This application is a continuation of U.S. patent application Ser. No. 08/462,449, filed Jun. 5, 1995, now abandoned, which was File Wrapper Continuation of U.S. patent application Ser. No. 08/148,092, filed Nov. 4, 1995 now abandoned.

FIELD OF THE INVENTION

The present invention relates, in general, to the field of printing presses and, in particular, to an apparatus for measuring web tension in the former section of a folding device for a printing press and generating control signals in response thereto.

BACKGROUND OF THE INVENTION

The printing industry is continually increasing the speed at which printed copies can be generated. Printing, forming, folding, and cutting operations are often performed by a continuous operation machine, feeding in a web of blank paper from a roller and yielding a printed, cut, and folded finished product. Without the measurement and control of tension, position, and speed, a printing press may operate improperly, causing problems in the feeding and forming of the web. The web may become misaligned or stressed too heavily and may cause misfeeds, tears, and resultant downtime. Continuous monitoring and control of web tension, position, and speed may therefore be required to increase the throughput of such machines.

Techniques have been available for measuring web tension at various points in a printing press process. U.S. Pat. No. 5,052,296 teaches a method of measuring and controlling tension in a web using a detection device on or near roller locations on the printing press apparatus. Similarly, Japanese Patent Publication No. 60-38309, titled "Paper Travelling Tension Control Device in Rotary Press" teaches the detection of web tension on the upstream side of a drag roller, with the resulting signal in a control circuit to adjust speed or pressure of driving rollers, thus modulating web tension.

None of the previous inventions teaches one skilled in the art to measure the web tension on the former board of the printing press. Further, the prior art does not teach specific techniques or devices for measuring tension, but focuses on the use of the measured signal in algorithms for the control of web tension.

The prior art teaches measurements of the web that are performed remotely from the former area. The present invention provides an apparatus suitable for measuring web tension in the former section of the printing press, as opposed to remote tension measurement locations.

OBJECTS AND SUMMARY OF THE INVENTION

It is an object of the present invention to provide a device for measuring the tension of a web over a former board of a folding machine.

It is also an object of the present invention to provide a device that measures tension at or near the former board without having effectively to interpolate the tension from another location remote from the former.

It is a further object of the present invention to provide a tension measuring device that produces a signal suitable for use in automatically controlling the tension of a web in the former section of the folding machine.

The present invention provides a device for measuring web tension over the former board of a folding machine for a printing press comprising a former board, a frame, a former board angle adjusting rod coupled at a first end to the former board and at a second end to the frame, and a sensor coupled to the former board angle adjusting rod generating a load signal proportional to a load on the former board angle adjusting rod imparted by the tension of a web running over the former board.

The present invention provides a device for measuring the tension of a web over the former section of a folding machine for a printing press to allow for general information gathering. The invention further provides for the generation of a signal corresponding to the web tension over the former section that can be used in a control algorithm for real time control of the web tension by adjusting suitable operating parameters of the printing press apparatus, such as driving roller pressures and speeds.

The present invention also provides a method for measuring and controlling web tension over a former board in a folding machine for a printing press. A web is fed over a former board coupled in the proximity of a first end to a frame and in the proximity of a second end to a first end of a former board angle adjusting rod, a second end of which rod is coupled to the frame. A mechanical load on the former board angle adjusting rod, imparted by a tension in the web, is transduced by a sensor into a signal proportional to the load. The load signal is transmitted from the sensor to an information processing device. One or more control signals are computed by the information processing device as a function of the load signal received from the sensor. The control signal or signals then are transmitted to one or more actuators, which provide an actuation in response to the receipt of the one or more control signals.

Other objects, advantages, and characteristics of the present invention will become apparent in view of the description and accompanying drawings that follow.

DETAILED DESCRIPTION

Figure 1:
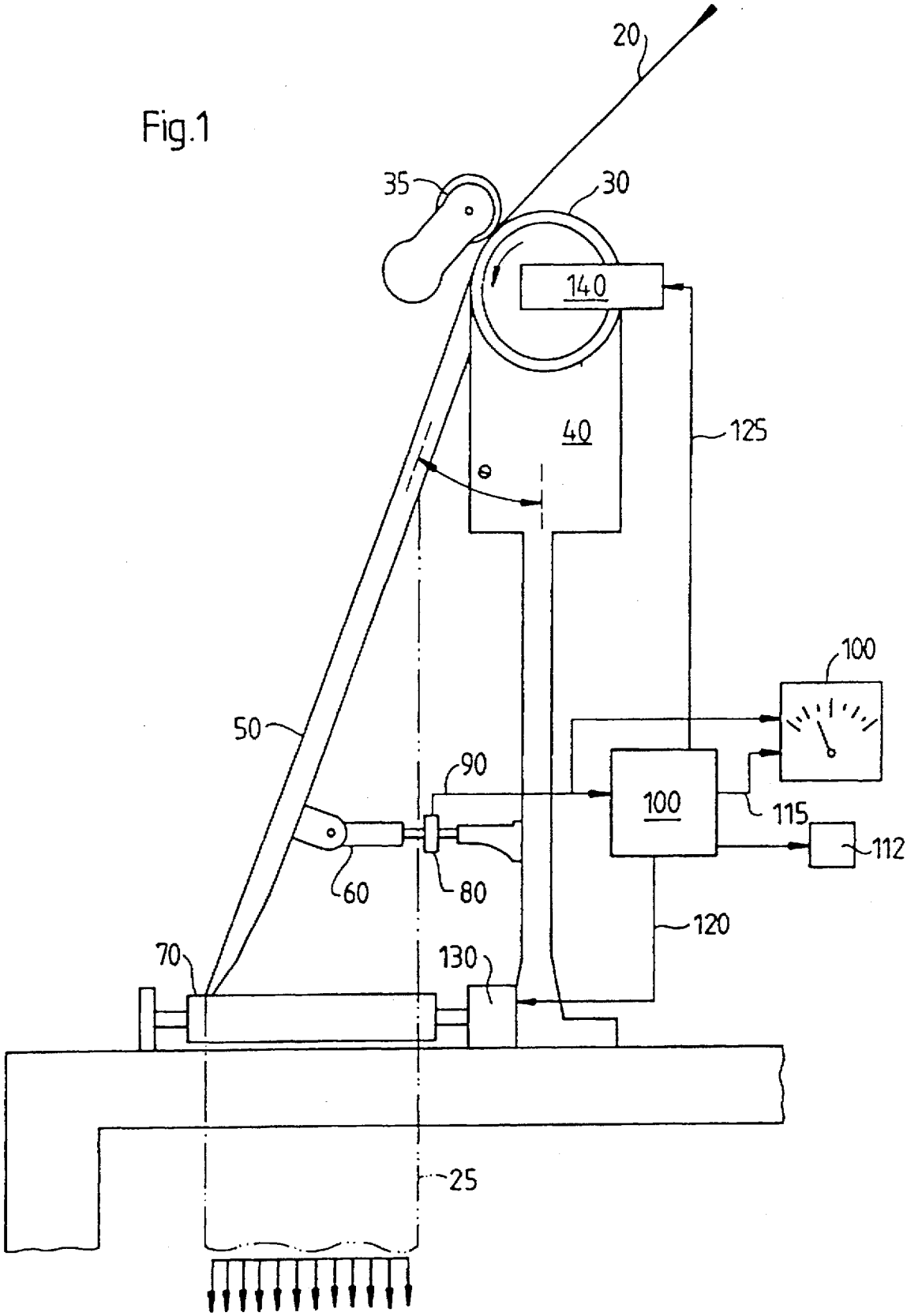
FIG. 1 is a side elevational view of a former section and a nip roller section of a folding machine with a tension measurement and control device according to the present invention.
Figure 2:
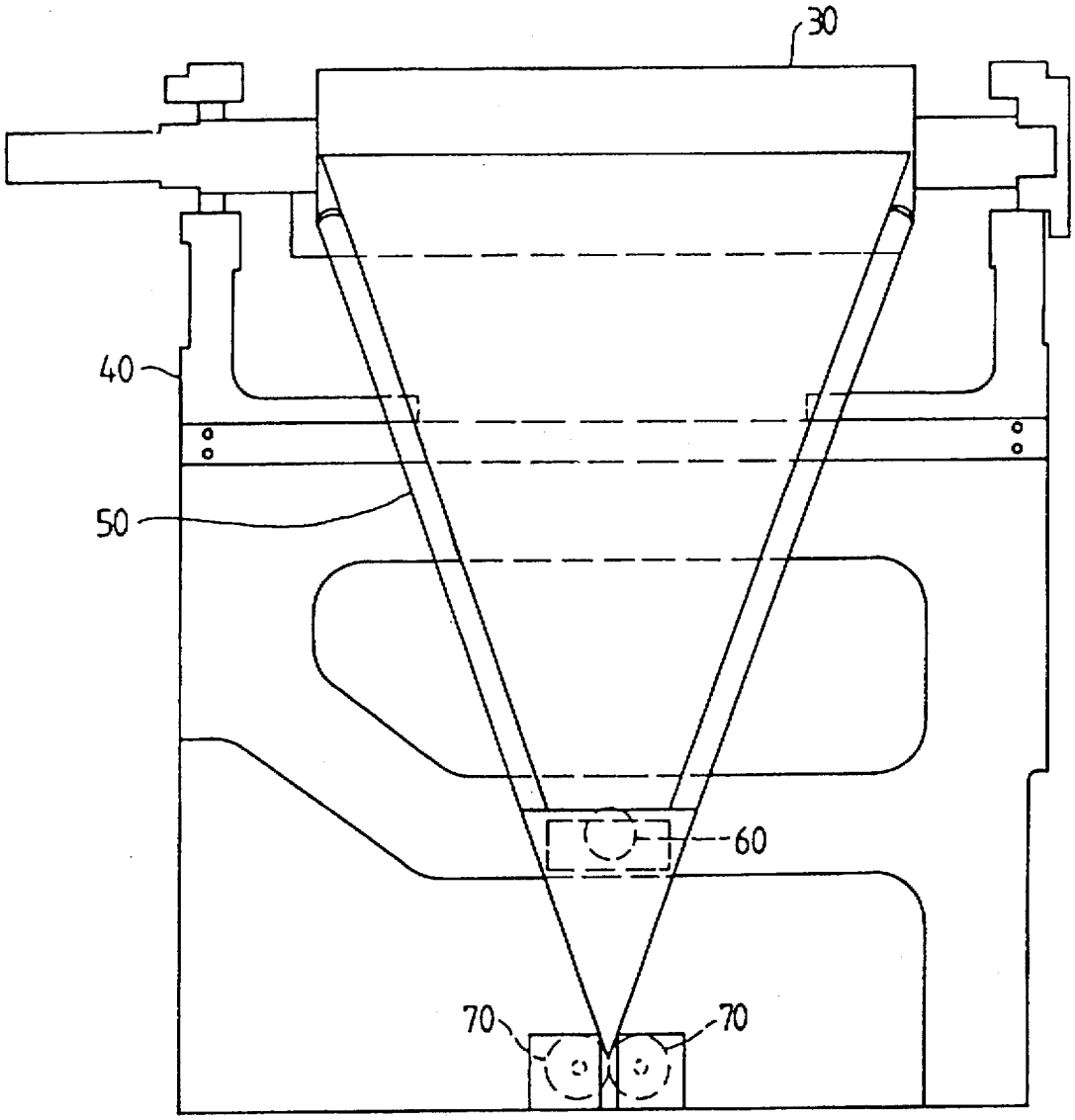
FIG. 2 is a front elevational view of the former section and nip roller section of a folding machine.

In FIG. 1, a device for measuring and controlling web tension over a former board of a folding machine for a printing press is shown. FIG. 2 provides an alternative view of the folding machine. In an embodiment of the present invention, a web 20 travels from a printing press (not shown) to a roller 30, which is typically a driven roller, supported by a frame 40. The web 20 travels over the surface of the roller 30 with a velocity approximately equal to the circumferential speed of the roller which substantially coincides with the speed of the web running through the press. While traveling over the surface of roller 30, web 20 is maintained in contact with roller 30, and under tension, by a nip roller 35. After traversing part of the arc of the roller 30, the web 20 parts contact with the roller 30 and comes into contact with a former board 50, disposed below the roller 30.

The former board 50 is triangular in shape with the top dimension (dimension along the roller 30) being approximately equal to the length of the roller 30, sufficient to receive the full width of the web 20 flat on the former board's top surface. The former board 50 is arranged so that its surface slants downward from the roller 30 forming an angle 8 with the frame 40, to which the former board 50 is rotatably coupled. The tip of the triangular surface of the former board points down and away from the roller 30 at the middle of the roller's length.

A former board angle adjusting rod 60 provides adjustable support to the former board 50 such that the angle Θ can be varied. The former board angle adjusting rod 60, which may be any suitable elongate structural member known in the art, possesses a first end rotatably coupled to the former board 50 near the lower extremity of the latter (substantially as shown in FIG. 1) and possesses a second end adjustably coupled, which may be by way of a threaded connection, to the frame 40.

The web 20 is pulled down over the former board 50 by a driven set of nip rollers 70. The nip rollers 70 are a pair of rollers positioned parallel to one another with their axes at least roughly perpendicular to the axis of the roller 30. The web 20 is folded in half longitudinally, yielding folded web 25. The folding of the web 20 is facilitated by the triangular shape of the former board over which the web 20 travels, which can be seen in FIG. 2. When the web 20 enters the nip rollers 70, it is folded along an axis substantially central to the web 20 and substantially pointwise parallel to the plane of the web 20, as shown in FIG. 1. The folded web 25 emerges from between the nip rollers 70.

As the web 20 is drawn over the former board 50, folded, and then drawn through the nip rollers 70, the former board 50 may be subjected to axial, flexural and normal loading by the web 20 resulting in the compressive loading of the former board angle adjusting rod 60. A sensor 80, which may be any transducer known for measuring mechanical stresses or strains, such as a lead cell or a strain gauge, is mounted on the former board angle adjusting rod 60 such that it transduces a load signal proportional to the compressive force imparted to the former board 50 by the web 20. Sensor 80 may be in communication via a transmission medium 90 (which may be any transmission medium, such as an electrically conductive wire) with an information display 100 (which may be a gauge or any other known means of information display, such as an LED or LCD, or a CRT), and/or with an information processing device 110. Information processing device 110 may be in communication with information display 100 via transmission medium 115, with nip rollers 70 via transmission medium 120, and with roller 30 via transmission medium 125. Information processing device 110 may also include one or more data storage elements or memories 112. The term "in communication with," as used here, is intended to denote a relation between objects such that information associated with a first object is provided to the second object by way of a transmission medium which may be coupled to each of the objects.

The load signal transduced by sensor 80 may be provided over transmission medium 90 directly to information display 100 for the visual display of the magnitude of a measured compressive force. The load signal transduced by the sensor 80 may, alternatively, or in addition, be provided to the information processing device 110. The information processing device 110 may be any means known in the art, such as an electronic regulator, programmable logic controller, computer, or any other known means for receiving one or more signals as input, performing logical and/or mathematical operations on the signals, and generating one or more output signals.

According to known methods implemented by the information processing device 110, one or more control signals may be generated as output(s) of the information processing device 110. The one or more control signals generated by the information processing device 110 as a function of the load signal received by the information processing device 110 from sensor 80 may be provided to one or more actuators 130 of the nip rollers 70, or the actuator 140 of the roller 30, via the transmission media 120 or 125, respectively. Actuator(s) 130 may be rotationally coupled to and drive the nip rollers 70, while actuator 140 may be rotationally coupled to and drive the roller 30. The control signals provided via transmission media 120 and 125 to the actuator (s) of nip rollers 70 or the actuator of roller 30 may modulate the speed of the appropriate actuator(s) and roller pressure and thus indirectly, but automatically, control the tension in the web by adjusting operating parameters of the press such as nip roller pressure and speed. The actuators 130 and 140 referred to above may be motors, such as a harmonic drive, for driving the rollers 30 and 70 or, in the case of squeezing the nip roller 35 to the roller 30, or squeezing the nip rollers 70 together, the actuator may also include a pneumatic cylinder controlled by one or more electronic regulators, or it may be any other suitable device.

As one example of the operation of the sensor 80, transmission medium 90, information display 100, and information processing device 110, in the control of web tension according to the present invention, the sensor 80 may be a load cell that produces a voltage as a positive function of a compressive force applied to the load cell. The voltage produced by the sensor 80, in this embodiment, may be subtracted by information processing device 110 from a control voltage provided to actuator 130 that controls the amount of pressure squeezing the set of nip rollers 70. Thus, when tension on the web 20 increases, resulting in a greater compressive force on the former board angle adjusting rod 60, and therefore in a higher voltage produced by the sensor 80 mounted on the adjusting rod 60, the voltage provided to the nip rollers 70 decreases. As a result, the nip rollers 70 squeeze the web 20 less tightly, and the tension imparted to web 20 is accordingly reduced. The negative feedback approach according to this example quickly leads to the establishment of an equilibrium tension in the web 20. The magnitude of the steady-state tension in the web 20 may thus be controlled by employing in this configuration a variable set point voltage.

As will be recognized by those skilled in the art, the present invention is not limited to the preferred embodiment here presented. For example, alternative configurations of the present invention can be conceived in which, for example, the former board angle adjusting rod 60 may be in tension rather than compression, or in which the force on the adjusting rod 60 may be measured by alternate means, or in which other members than the nip rollers 70 are actuated to control tension. For example, regulator 140 may be driven, as shown in FIG. 1. Similarly, rollers in the printing machine may be freewheeling (driven by friction from contact with the moving web) rather than driven by external means.

The embodiments of the present invention shown in the schematic drawings and described above are intended to be representative only. It will be clear to those skilled in the art that many variations on those shown may be employed. All such variations are intended to be within the scope and spirit of the present invention.

What is claimed is:

1. A device for measuring web tension over a former board in a folding machine for a printing press comprising:

a former board;

a frame;

a former board angle adjusting rod coupled at a first end to the former board and at a second end to the frame;

a plurality of nip rollers; and a sensor coupled to the former board angle adjusting rod, the sensor directly measuring an axial load applied to the former board angle adjusting rod as a web is drawn over the former board and generating a signal proportional to the axial load on the former board angle adjusting rod, wherein the signal is indicative of a tension in the web by being proportional to a compressive force imparted to the former board by the web being drawn over the former board, folded, and then drawn through the nip rollers.

2. The device according to claim 1, further comprising an information display in communication with the sensor for providing a visual indication of web tension.

3. The device according to claim 1, further comprising an information processing device in communication with the sensor.

4. The device according to claim 3, wherein the information processing device operates on the signal generated by the sensor to produce one or more control signals.

5. The device according to claim 4, wherein the information processing device is in communication with one or more actuators and the one or more control signals produced by the information processing device are provided to the one or more actuators.

6. The device according to claim 5, wherein one of the one or more actuators includes a pneumatic cylinder controlled by one or more electronic regulators.

7. The device according to claim 5, wherein one of the one or more actuators includes a motor actuating a roller disposed adjacent to a leading edge of the former board.

8. The device according to claim 5, wherein one of the one or more actuators includes a nip roller motor.

9. The device according to claim 8, wherein:

the nip rollers are coupled to the nip roller motor, the nip rollers receiving the web as it exits the former board, the nip roller motor controlling the tension in the web in response to the one or more control signals produced by the information processing device.

10. A method for measuring and displaying web tension over a former board in a folding machine for a printing press comprising the steps of:

feeding a web over a former board coupled in the proximity of a first end to a frame and in the proximity of second end to a first end of a former board angle adjusting rod being coupled to the frame;

drawing the web through nip rollers;

transducing, with a sensor, a mechanical load on the former board angle adjusting rod as the web is drawn over the former board, the mechanical load being imparted by a tension in the web and proportional to a compressive force imparted to the former board by the web as it is drawn over the former board, folded, and then drawn through the nip rollers; and transmitting a load signal proportional to the mechanical load via a transmission medium from the sensor to a visual display device.

11. A method for measuring and controlling web tension over a former board in a folding machine for a printing press comprising the steps of:

feeding a web over a former board coupled in the proximity of a first end to a frame and in the proximity of a second end to a first end of a former board angle adjusting rod, a second end of the former board angle adjusting rod being coupled to the frame;

drawing the web through nip rollers;

transducing, with a sensor, a mechanical load on the former board angle adjusting rod as the web is drawn over the former board, the mechanical load being imparted by a tension in the web and proportional to a compressive force imparted to the former board by the web as it is drawn over the former board, folded, and then drawn through the nip rollers;

transmitting a load signal proportional to the mechanical load via a first transmission medium from the sensor to an information processing device;

computing with the information processing device one or more control signals as a function of the load signal;

transmitting via at least a second transmission medium the one or more control signals to one or more actuators; and actuating the one or more actuators in response to the receipt of the one or more control signals.

12. A method according to claim 11, further comprising the steps of calculating a value corresponding to the load signal and transmitting the value from the information processing device to a memory and storing the value therein.

* * * * *